United States Patent [19]

Bolton et al.

[11] Patent Number: 4,651,959

[45] Date of Patent: Mar. 24, 1987

[54] MOUNTING FOR A ROOM AIR CONDITIONER

[75] Inventors: Theodore S. Bolton; James E. Napolitano, both of Liverpool, N.Y.

[73] Assignee: Carrier Corporation, Syracuse, N.Y.

[21] Appl. No.: 778,107

[22] Filed: Sep. 20, 1985

[51] Int. Cl.[4] ..... A47F 5/00; E06B 7/28

[52] U.S. Cl. ..... 248/208; 29/453; 29/526 R; 62/262

[58] Field of Search ..... 29/453, 526 R; 62/262, 62/263, 259.1; 248/208

[56] References Cited

U.S. PATENT DOCUMENTS

| | | | |
|---|---|---|---|
| 2,436,713 | 2/1948 | Cody | 62/262 X |
| 2,576,114 | 4/1971 | Sharp et al. | 62/262 |
| 2,674,430 | 4/1954 | Galazzi | 248/208 X |
| 2,891,754 | 6/1959 | Kuhlenschmidt et al. | 248/208 |
| 2,945,358 | 7/1960 | MacLeod et al. | 62/262 |
| 2,998,711 | 9/1961 | Komroff | 62/262 |
| 3,030,873 | 4/1962 | Metcalfe | 248/208 X |
| 3,151,791 | 10/1964 | Pietsch | 248/208 X |
| 3,213,636 | 10/1965 | MacLeod | 62/262 |
| 3,271,972 | 9/1966 | Knight | 62/262 |
| 3,273,843 | 9/1966 | Bell, Jr. et al. | 248/208 |
| 3,491,549 | 1/1970 | Oglesby | 62/262 |
| 3,548,611 | 12/1970 | Ulich | 62/262 |

FOREIGN PATENT DOCUMENTS

| | | | |
|---|---|---|---|
| 699215 | 12/1964 | Canada | 62/263 |
| 102035 | 6/1983 | Japan | 62/262 |
| 93131 | 5/1984 | Japan | 62/262 |

*Primary Examiner*—Charlie T. Moon

*Attorney, Agent, or Firm*—Dana F. Bigelow

[57] ABSTRACT

Method and apparatus are provided for mounting an air conditioner in a wall opening with a single bracket attached to the lower wall and extending upwardly into the wall opening. The air conditioning housing is formed with a lip on its upper surface to engage the inner surface of the upper wall, and an indent on its lower wall to receive the upwardly extending bracket when the air conditioner slips down into its installed position. Means are provided to secure the bracket to the air conditioner housing to prevent removal of the system from outside the building.

5 Claims, 4 Drawing Figures

MOUNTING FOR A ROOM AIR CONDITIONER

BACKGROUND OF THE INVENTION

This invention relates generally to room air conditioners and more particularly, to a method and apparatus for mounting a room air conditioner in a wall opening.

The typical room air conditioner comprises an outdoor section and an indoor section, the outdoor section being in heat exchange relationship with the outdoor air, and the indoor section being in heat exchange relationship with the indoor air. The preferred installation technique has, therefore, been to mount the air conditioning unit in an outside wall of the room to be air conditioned.

Because of the seasonal nature of the air conditioning systems, and because of the need to simplify the processes of periodically installing and removing the air conditioning units, an existing window opening was, and remains, a common location for the mounting of an air conditioning unit. The unit can simply be placed on the windowsill or stool, and then have the sash brought down tightly at its upper surface to secure the unit in its installed position. Size adjustable filler panels are used at the sides in order to accommodate the various sizes of window openings in air conditioning units.

For purposes of safety, various types of supporting shelves, brackets, clamps, collars, and the like have been used to provide support for and to securely fasten the air conditioning unit within the window opening. Generally, these installation techniques have been somewhat complicated and time consuming.

In many new construction projects, air conditioning is being included as one of the original design considerations. This is especially true in hot climates where air conditioning has almost become a necessity. Accordingly, it has become common practice to permanently mount air conditioning units in dedicated wall openings. These so-called "through-the-wall" units are thus installed during the later stages of the construction process and remain in those installed positions except for removal as required for repair, maintenance or replacement. The annual installation and removal process is not required with these units but, the initial installation process, and any subsequent removal and replacement as necessitated for the reasons mentioned above, may still involve a substantial amount of time. This is particularly true in multi-unit buildings, such as apartment complexes, where hundreds of units may be involved.

It is, therefore, an object of the present invention to provide an improved method and apparatus for installing room air conditioners.

Another object of the present invention is to provide a through-the-wall air conditioning unit installation technique which is simple and easy to implement.

Yet another object of the present invention is the provision for a through-the-wall air conditioning unit mounting apparatus that is economical to manufacture and extremely practical in use.

These objects and other features and advantages become more readily apparent upon reference to the following description when taken in conjunction with the appended drawings.

SUMMARY OF THE INVENTION

Briefly, in accordance with one aspect of the invention, the air conditioning unit housing is formed with an indent extending transversely across its lower surface and a lip extending transversely across its upper surface, with both being vertically aligned in a plane intended for alignment with the inner surface of the wall. The wall opening is sized appropriately to allow the outdoor portion to be inserted from the inside while, at the same time, providing for an abutting relationship between the lip and the inner surface of the wall. A securing bracket is fastened transversely across the lower wall such that a portion thereof extends upwardly into the wall opening. The air conditioning unit is then placed into the opening and pushed outwardly until the upper lip abuts the inner surface of the upper wall. The lower edge of the unit is then further pushed outwardly until the bracket upwardly extending portion reaches the indent in the lower surface of the housing. The entire unit is then allowed to slip downwardly such that the upwardly extending portion slides into the indent to thereby hold the unit in its installed position with its weight being supported by the lower wall, and with the moment arm of the outdoor portion tending to maintain the upper lip against the inner surface of the upper wall. Any subsequent removal can be accomplished by simply raising up on the indoor portion of the unit until the upwardly extending portion is disengaged from the indent, and then pulling the entire unit inwardly from the opening.

In accordance with another aspect of the invention, the securing bracket comprises a Z-bar with one leg fastened to the bottom horizontal surface of the wall opening. Further, the unit may be secured, to prevent removal from outside the wall, by simply fastening the Z-bar upwardly extending portion to the unit housing by appropriate fasteners such as screws or the like.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
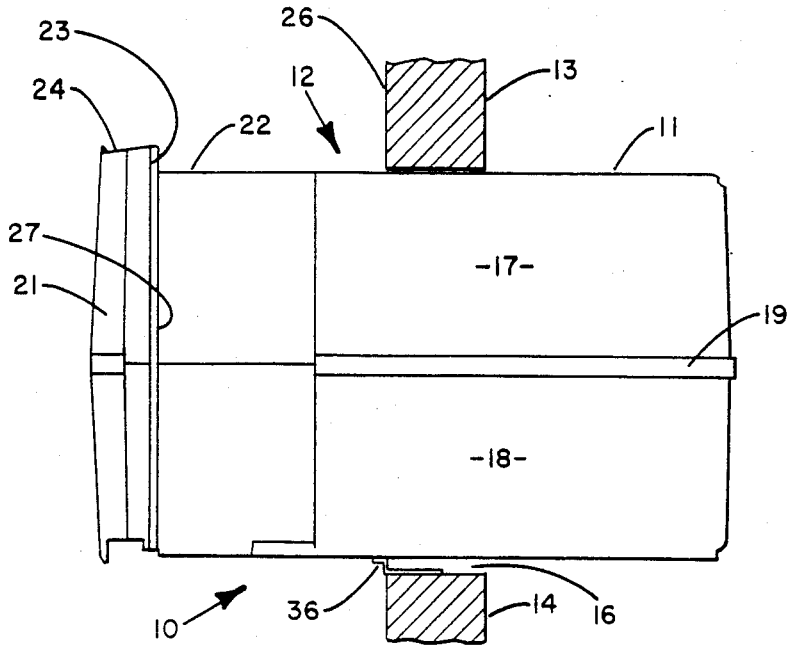
FIGS. 1, 2 and 3 are side elevational views of the mounting apparatus in progressive stages of the installation of an air conditioning system in accordance with the preferred embodiment of the invention.
Figure 2:
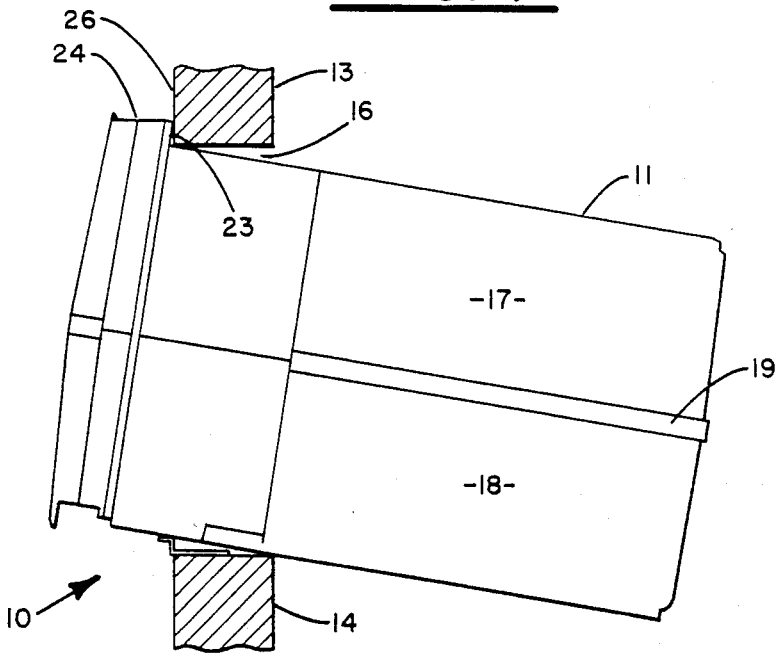
Figure 3:
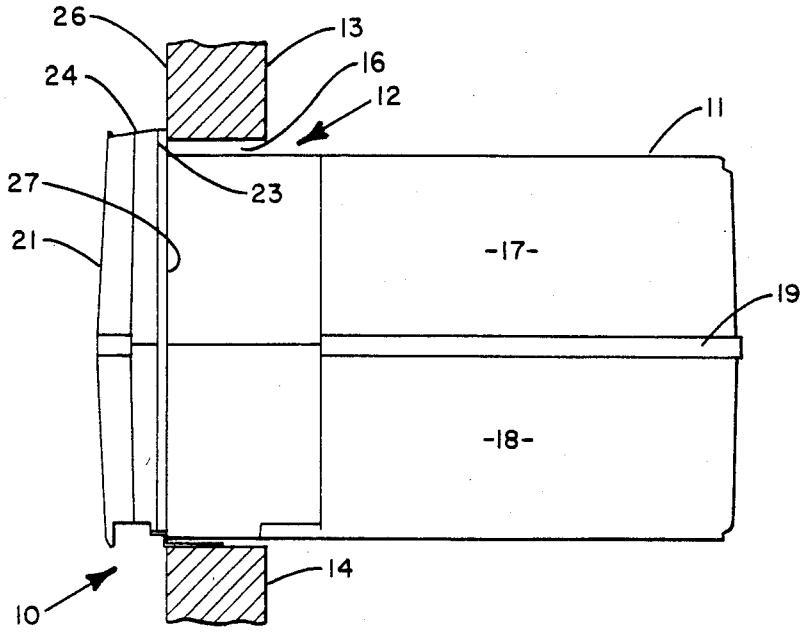

Referring now to FIGS. 1, 2 and 3, the invention is shown generally at 10 as applied to an otherwise conventional air conditioning system 11 to be mounted in a wall opening 12 defined by upper and lower walls 13 and 14 and opposing side walls, one of which is shown at 16. While the opening 12 is shown as a dedicated opening formed in the outer wall of the building specifically for the purpose of mounting the air conditioning system 11 therein, the present invention may, as well, be applicable to a window opening bordered by the windowsill at the bottom, the sash at the top, and window frame members at the sides.

The particular air conditioning system 11 shown is one comprised of upper and lower shell members 17 and 18, fabricated of a non-metallic, molded material and secured together by channel members 19. However, the type, size, and shape of the air conditioning system, or its outer casing, can be varied while remaining within the scope of the present invention. Generally, the air conditioning system includes an outdoor section which is placed proximate the end which is located on the outer side of the wall (at the right in FIG. 1) and an indoor section which is placed proximate the other end of the system located on the inner side of the wall. A front cover 21 is removably installed on the indoor end of the air conditioning system as shown.

Referring to FIG. 1, it will be seen that the system upper casing 17 has an upper surface 22 which is planar throughout most of its length. However, near the inward end, there is an upward projection or lip 23 which extends substantially normally from the surface 22 and then generally inwardly at the tapered surface 24. It is the surface of the lip 23 which is intended to fit tightly against the inside surface 26 of the upper wall 13 as shown in FIG. 3. A strip of insulation is preferably provided over the lip surface 23 as well as around the adjoining side surfaces as shown at 27 so that a relatively airtight seal can be obtained around the air conditioning casing at the point where it interfaces with the upper and side side walls.

Figure 4:
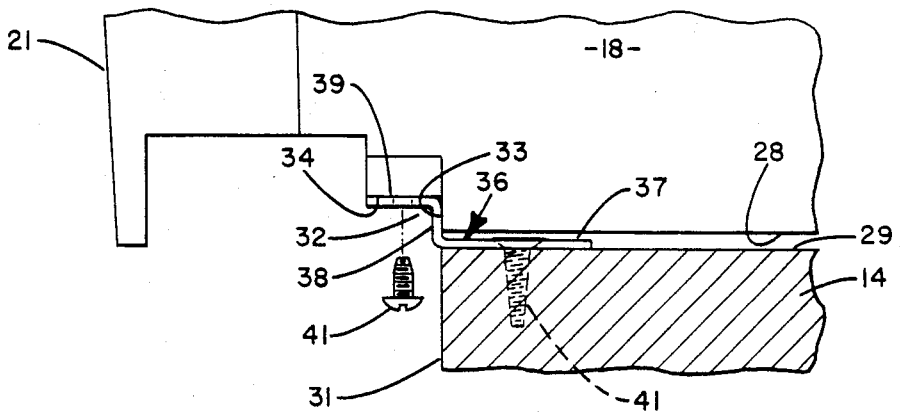
FIG. 4 is a partial view thereof showing the securing bracket portion thereof.

A portion of the lower casing 18, at the point where it passes through the lower wall 14, is shown in FIG. 4. The lower casing 18 includes a planar portion 28 which is intended for disposition over, and to be vertically supported by, the horizontal surface 29 extending transversely across the lower wall 14 as shown. At a position directly above the inner surface 31 of the lower wall 14, an indent 32 is formed of the upwardly and inwardly extending surfaces 33 and 34, respectively. This indent 32 is formed in the lower casing 18 for the purpose of mounting the system in accordance with the present invention.

To facilitate the mounting of the air conditioning system 11 within the wall opening 12, a Z-shaped bracket or Z-bar 36 formed of outer, intermediate, and inner legs 37, 38 and 39, respectively, extends transversely across the top surface 29 of the lower wall 14 and is secured thereto by a plurality of fasteners, one of which is shown at 41. The Z-shaped bracket 36 is so shaped in cross-section so as to conform generally to the Z-shape of the interconnected planar wall 28, the upward extending wall 33 and inward extending wall 34 of the indent 32. Such that when the air conditioning system 11 is installed into the wall opening 12 from the inside, the free end of the Z-shaped bracket 36 will engage the indent 32 with the respective walls 38 and 33 being in close fit relationship to thereby secure the lower casing 18 within the opening 12.

In order to prevent the possible removal of the air conditioning system 11 from the wall opening 12 by raising up the system from the outside to disengage the Z-shaped bracket 36 from the notch 32, one or more fasteners 41 can be used to attach the inner leg 39 of the Z-shaped bracket 36 to the inwardly extending wall 34 of the lower casing 18.

Having described the structure of the air conditioner mounting apparatus, the method of installation will now be described. The various stages of installation are shown in sequential order in FIGS. 1-3. The air conditioning system is first placed into the wall opening 12 from the inner side of the wall as shown in FIG. 1. The wall opening 12 is sized at its upper and lower borders such that there is just enough clearance between the upper wall 13 and the Z-shaped bracket 36 to allow for insertion of the air conditioning casing as shown in FIG. 1. The clearance on the sides should be such as to provide a small clearance to allow for easy installation while at the same time providing a close enough fit that the overlapping side portion, together with its insulating material 27, will be in a close fit sealing relationship with the inner surface of the wall.

Continuing with the installation process, the air conditioning system is pushed outwardly until the upwardly extending lip 23 is flush against the inner wall surface 26 as shown in FIG. 2. At this point, because of the weight distribution of the system 11, the outer end of the system will tend to hang downwardly as shown in FIG. 2. The next step is to push further outwardly on the lower side of the system until the upwardly extending portion of the Z-shaped bracket 36 engages the indent 32. At that point, the entire unit will drop downwardly such that the indent inwardly extending surface 34 will rest on the inner leg 39 of the Z-bar 36. The fastener(s) 41 can then be installed to secure the system in position. In this installed position, the Z-bar will be supporting the weight of the system, and the weight of the system, as cantilevered outwardly from that fulcrum point, will tend to maintain the upper lip 23 tightly against the inner wall surface 26 as shown on FIG. 3.

Although the invention has been described in terms of particular structure, it should be understood that other forms may be used while remaining within the scope of the present invention. For example, although the inventive method and apparatus has been described as being implemented with a Z-shaped bracket, it will be understood that other forms of the bracket, and methods of attachment may be used as well. It is only necessary that the bracket be attached in some way to the lower wall 14, and that it extend upwardly to engage the associated notch in the system housing.

What is claimed is:

1. Apparatus for mounting an air conditioner in a wall opening defined by fixed upper, lower and side walls comprising:

an air conditioner housing for containing outdoor and indoor sections, said housing being mounted in the wall opening with an outdoor portion of said outdoor section being disposed on the outer side of the wall opening and an indoor portion of said indoor section being disposed on the inner side of the wall opening;

the step formed on the lower side of said indoor portion said step including a securement surface extending substantially facing said indoor portion and the wall opening;

an L-shaped bracket having one leg thereof attached to the upper surface of the bottom wall and a second leg extending upwardly into said step against said securement surface; such that the moment arm of said outdoor portion tends to bias said lip against the inner side of said upper wall and said step secured surface against said bracket securing portion.

2. Apparatus as set forth in claim 1 wherein said bracket is Z-shaped in form, with one leg secured to the top surface of the lower wall, a second leg extending upwardly into said step, and the third leg extending inwardly, in parallel relationship said first leg.

3. Apparatus as set forth in claim 1 and including gasket means disposed between said indoor portion and the upper and side walls to provide a sealing relationship therebetween.

4. Apparatus for mounting an air conditioning housing in a wall opening having fixed top, bottom and side walls comprising:

a bracket having an L-shape with one leg thereof attached to the upper surface of the bottom wall and a second leg extending generally normally therefrom facing said indoor portion and a lip on an upper surface of the indoor portion of the air conditioning housing, said lip extending upwardly to overlap a portion of said top wall and to bear against the inner surface thereof when the housing is supported in cantilever fashion by the bracket.

5. Apparatus as set forth in claim 4 wherein said bracket is Z-shaped and includes a third leg attached to said second leg and extending substantially parallel to said first leg.

* * * * *